US007481147B1

(12) United States Patent
Serkland et al.

(10) Patent No.: US 7,481,147 B1
(45) Date of Patent: Jan. 27, 2009

(54) EXTERNAL, UNDERSIDE POSITIONED AIRCRAFT OBJECT MOUNTING SYSTEM

(75) Inventors: M. Damon Serkland, Garland, TX (US); Steve S. Cone, Muenster, TX (US); James A. Hardin, Princeton, TX (US)

(73) Assignee: Contract Fabrication & Design, LLC, Princeton, TX (US)

( * ) Notice: Subject to any disclaimer, the term of this patent is extended or adjusted under 35 U.S.C. 154(b) by 416 days.

(21) Appl. No.: 11/253,008

(22) Filed: Oct. 18, 2005

(51) Int. Cl.
*F41A 23/00* (2006.01)

(52) U.S. Cl. ..... 89/37.22; 89/1.53; 89/1.54; 244/137.4; 244/118.1

(58) Field of Classification Search ..... 89/37.16, 89/37.17, 37.19, 37.21, 37.22, 1.52, 1.53, 89/1.54, 1.58, 1.59; 244/137.1, 137.4, 118.1, 244/118.2
See application file for complete search history.

(56) References Cited

U.S. PATENT DOCUMENTS 2,953,330 A * 9/1960 Lysak ..... 244/118.1
4,632,338 A * 12/1986 Hasquenoph et al. .... 244/137.4
4,893,545 A 1/1990 Sanderson et al.
4,966,063 A 10/1990 Sanderson et al.
4,974,499 A 12/1990 Sanderson et al.
5,024,138 A * 6/1991 Sanderson et al. ..... 89/37.22
5,187,318 A 2/1993 Sanderson et al.
5,263,397 A 11/1993 Sanderson
5,390,582 A 2/1995 Sanderson
5,417,141 A 5/1995 Sanderson
5,419,234 A 5/1995 Sanderson
5,421,239 A 6/1995 Sanderson
5,517,895 A 5/1996 Sanderson
5,767,436 A 6/1998 Sanderson
6,012,677 A * 1/2000 Mazzoni ..... 244/118.1
6,176,167 B1 1/2001 Sanderson
6,241,185 B1 6/2001 Sanderson
6,250,196 B1 6/2001 Sanderson
6,293,016 B1 9/2001 Sanderson
6,293,179 B1 9/2001 Sanderson
6,820,532 B2 * 11/2004 Sanderson ..... 89/41.18

* cited by examiner

*Primary Examiner*—Stephen M Johnson
(74) *Attorney, Agent, or Firm*—Haynes and Boone, LLP

(57) ABSTRACT

An aircraft object mounting system is formed from three light weight honeycombed metal plank sections—a longitudinally central section and a pair of upturned end sections removably secured thereto. The end sections have bomb racks thereon to which various weaponry, such as machine guns, rocket launchers or missiles, may be attached. The central section is secured to the underside of a helicopter, with small lug structures on the central section extending upwardly into the aircraft cabin area and secured to bulkheads therein. The object mounting system is thus positioned essentially entirely externally to the aircraft and only minimally intrudes into the interior thereof. The mounting system may be used to support non-weaponry objects, and may be utilized with aircraft other than helicopters.

26 Claims, 4 Drawing Sheets

EXTERNAL, UNDERSIDE POSITIONED AIRCRAFT OBJECT MOUNTING SYSTEM

BACKGROUND OF THE INVENTION

The present invention relates generally to apparatus for externally mounting objects, such as weapons, on an aircraft and, in a representatively illustrated embodiment thereof, more particularly provides a specially designed object mounting system externally securable to the underside of an aircraft such as a helicopter and useable to support various types of objects in horizontally outwardly spaced relationships with opposite vertical sides of the aircraft.

Previously utilized techniques for externally mounting weaponry on aircraft, such as machine guns, rocket launchers and the like, particularly in retrofit applications, has heretofore carried with it a variety of structural, operational and other limitations and disadvantages. As an example, the external mounting of machine guns on a helicopter has previously entailed securing outwardly projecting metal tubes to the opposite sides of the helicopter, with inner end portions of the tubes extending through side openings in the helicopter body and being telescoped into larger support tubes horizontally anchored within the helicopter cabin area.

Due to unavoidable limberness in the support tubes, this weaponry support technique often led to firing inaccuracies in the mounted guns due to undesirable movement of their firing axes relative to the aircraft. Moreover, this weaponry mounting technique tended to undesirably take up an appreciable amount of space within the aircraft cabin. Further, this previously utilized weaponry support structure added considerable weight to the aircraft—a particularly undesirable characteristic in instances in which the guns are to be mounted on relatively light weight helicopters and fixed wing aircraft.

To a great extent these problems have been eliminated by using the light weight honeycombed metal support plank structure illustrated and described in U.S. Pat. No. 5,024,138 to Sanderson et al. This plank or beam structure is transversely insertable through the cabin portion of the aircraft in a manner such that a longitudinally central portion of the support plank is disposed within the cabin area, and outer end portions of the plank project outwardly from opposite sides of the body of the aircraft. The central plank portion within the cabin area is removably secured to a cabin floor area of the aircraft (which may be a helicopter or a fixed wing aircraft). Various weaponry, such as machine guns, rocket launchers, missiles and the like (as well as a variety of non-weaponry objects) may be mounted to the outwardly projecting end portions of the plank structure.

Although this support plank-based aircraft object mounting system has proven to be quite well suited for its intended purpose, and structurally superior to metal tube-type weaponry support systems, it does occupy an appreciable amount of aircraft cabin floor space which could be used for other purposes. A need thus exists for an improved aircraft object mounting system that maintains the benefits of this plank-based system but substantially reduces the intrusion of the mounting system into the aircraft cabin area. It is to this need that the present invention is primarily directed.

SUMMARY OF THE INVENTION

In carrying out principles of the present invention, in accordance with a preferred embodiment thereof, a specially designed mounting system is provided for externally mounting weaponry, such as machine guns, rocket launchers and missiles, or other objects, on an aircraft. The aircraft may be a helicopter or a fixed wing plane having an elongated body portion with a bottom exterior side underlying an interior area, representatively a cabin area, within the body portion, and opposite exterior sides extending upwardly from the bottom exterior side.

The object mounting system comprises an elongated mounting structure having a horizontally positionable central longitudinal section with upturned opposite longitudinal end sections having outer ends. Alternatively, the end sections may be downturned or non-angled relative to the central longitudinal section. Support structures, to which weaponry or other objects may be mounted, are disposed on the outer ends of the longitudinal end sections. Attachment apparatus is provided for horizontally securing the mounting structure central longitudinal section to the bottom exterior side of the aircraft body portion in a manner such that the central longitudinal section is beneath the bottom exterior side of the aircraft body portion and longitudinally extends transversely to its length, with the support structures being positioned in horizontally outwardly spaced relationships with the exterior sides of the aircraft body portion and (when upturned end sections are utilized) elevated relative to the bottom exterior side of the aircraft body portion.

Preferably, the mounting structure has a non-tubular, generally plank-shaped configuration, and is of a honeycombed metal construction. The opposite longitudinal end sections are preferably removably secured to the opposite ends of the central longitudinal sections, but may alternatively be an integral portion of the central section. In their upturned embodiment each of the opposite longitudinal end sections is upturned at an angle of between about thirty degrees and about forty five degrees relative to the central longitudinal section. When weaponry is being supported, the support structures are representatively bomb racks. When non-weaponry objects are being supported, other types of support structures may be utilized.

Illustratively, the attachment apparatus includes a first attachment structure securable within the interior area, and a second attachment structure secured to the central longitudinal section and attachable to the first attachment structure. Preferably, the attachment apparatus is extendable through at least one opening in the bottom exterior side of the aircraft, with the first attachment structure being a hollow block member securable within the interior area of the aircraft, and the second attachment structure being a lug member telescopingly and releasably receivable in the hollow block member.

DETAILED DESCRIPTION

Figure 1:
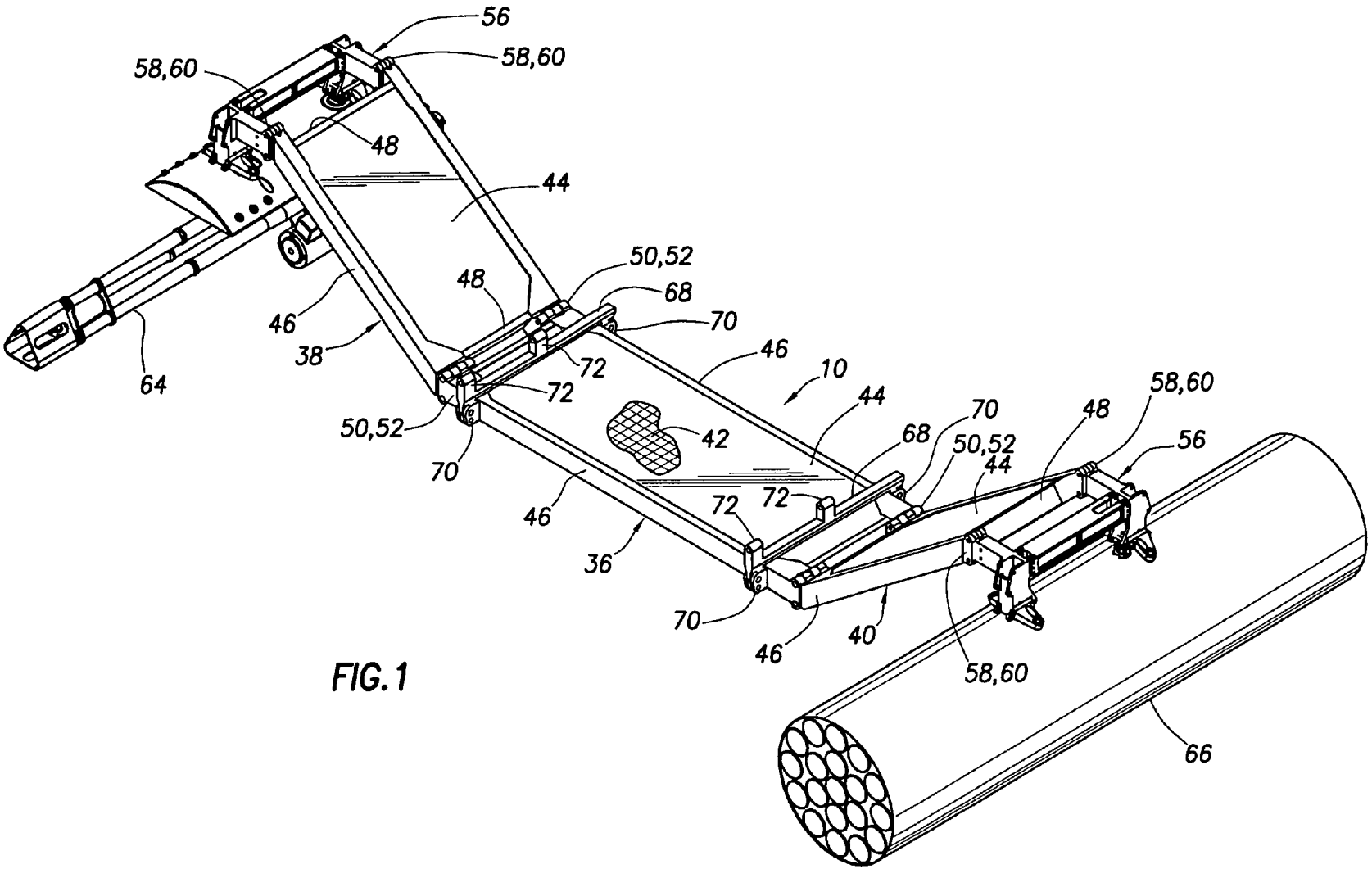
FIG. 1 is a partially cut away perspective view of an external, underside positioned aircraft object mounting system embodying principles of the present invention.
Figure 2:
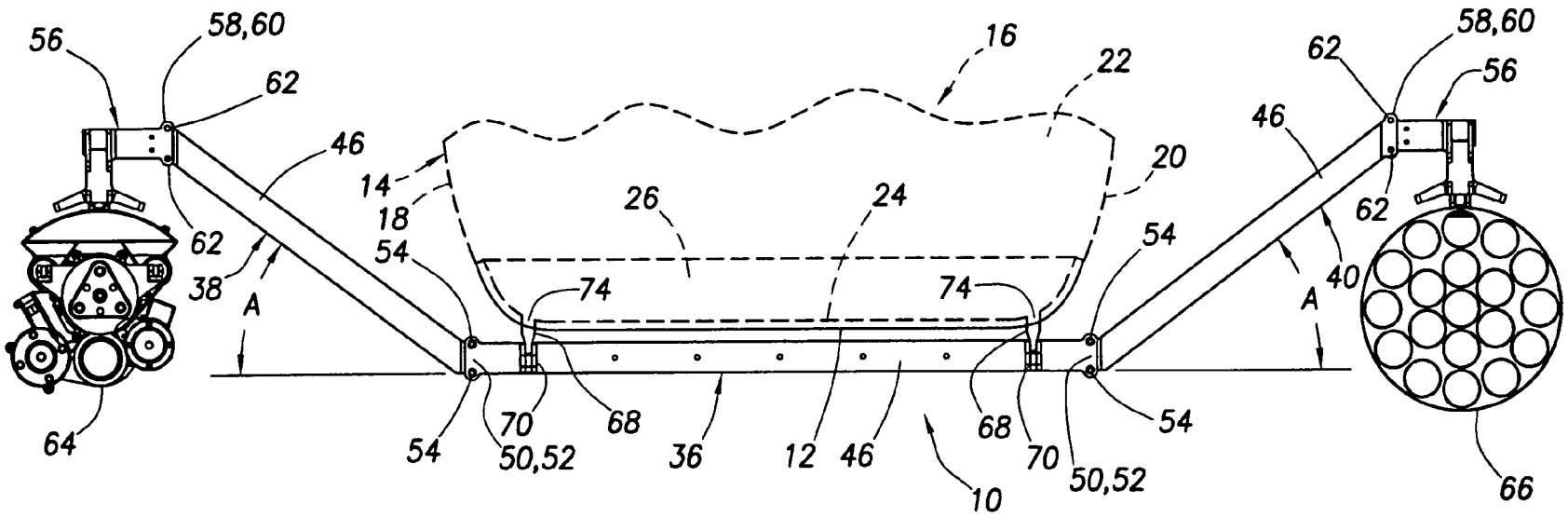
FIG. 2 is a front elevational view of the object mounting system operatively secured to the underside of the body of a representative helicopter, a portion of which is illustrated in phantom.

Illustrated in FIGS. 1-4 is a specially designed light weight object mounting system 10 which may be externally secured to the bottom side 12 of a body portion 14 an aircraft 16 which is representatively a helicopter but may alternatively be a fixed wing aircraft. Extending upwardly from the bottom side 12 are opposite generally vertical walls 18,20 of the body portion 14 which are positioned on opposite sides of an interior portion of the aircraft body portion 14, representatively a cabin area 22 having a floor 24.

Figure 3:
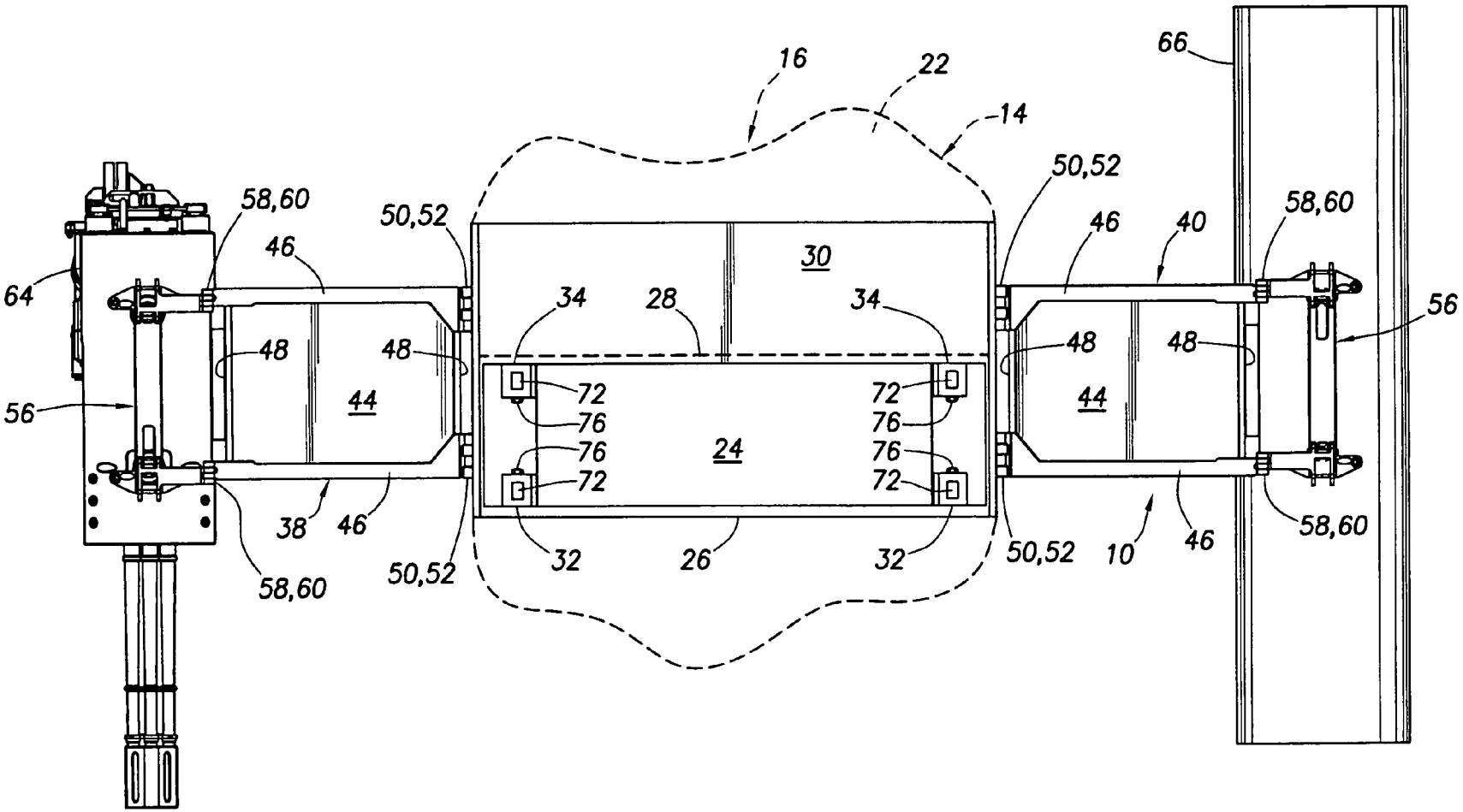
FIG. 3 is a top plan view of the object mounting system and a cabin area of the helicopter to which the system is operatively mounted.
Figure 4:
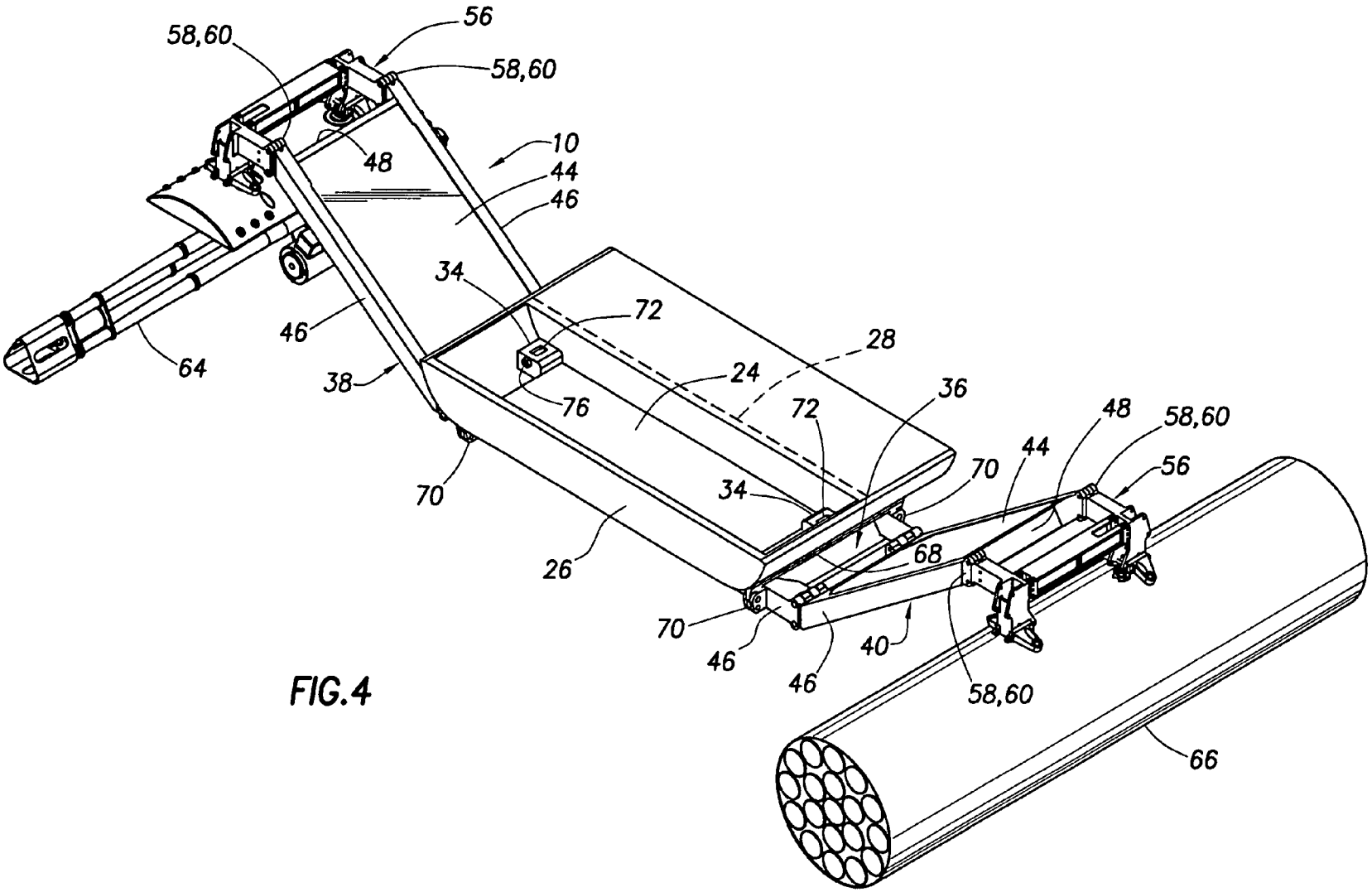
FIG. 4 is a perspective view of the cabin area with the object mounting system secured thereto.

A spaced apart parallel pair of horizontally elongated, generally plate-shaped reinforcing bulkheads 26,28 longitudinally extend transversely along the cabin floor 24, with the bulkhead 26 being spaced forwardly apart from the bulkhead 28 as viewed in FIGS. 3 and 4. An elongated seat structure 30 has a front edge portion that rests atop the bulkhead 28 and laterally extends rearwardly therefrom. For purposes later described herein, two facing pairs of hollow rectangular mounting blocks 32,34 are suitably anchored to opposing end portions of the bulkheads 26,28 at the cabin floor 24.

The object mounting system 10 includes three elongated, generally plank-shaped support beam sections—a longitudinally central section 36, and two opposite end sections 38 and 40. Each beam section representatively has a honeycombed metal core 42 covered on top and bottom sides thereof by an outer sheet metal skin 44. Other suitable materials could be alternatively used if desired. Metal side edge struts 46 extend along front and rear side edges of the beam sections 36,38,40, and metal end cover panels extend along opposite ends of each beam section. Spaced pluralities of mounting lugs 50,52 respectively formed on the outer ends of the central beam section 36 and the inner ends of the end beam sections 38,40 are interdigitated with another and releasably pinned together, as at 54, to releasably hold the beam end sections 38,40, in locked orientations, at upturned angles "A" relative to the horizontally disposed central beam section 36 (see FIG. 2). Representatively, but not by way of limitation, angle A is in the range of from about 30 degrees to about 45 degrees. Alternatively, the outer beam end sections 38,40 could be downturned, or non-angled, relative to the central beam section 36.

Mounted on the outer or upper ends of the beam end sections 38,40 are support structures 56, representatively in the form of conventional bomb racks. Bomb racks 56 have spaced pluralities of lugs 56 which are interdigitated with corresponding spaced pluralities of lugs 58 on the outer ends of the beam end sections 38,40 and pinned thereto as at 62. The bomb racks 56 may be supportingly connected to top side portions of is various types of weaponry such the representatively illustrated .50 caliber machine gun 64 and multi-tube rocket launcher 66. Other types of weaponry, such as other types of machine guns, missiles, etc. may alternatively be supported on the bomb racks 56 or other types of weaponry support structures if desired. Additionally, other types of support structures 56 could be used to support a variety of non-weaponry objects if desired.

AS best illustrated in FIG. 1, to permit operative attachment of the object mounting system 10 to the bottom side 12 of the aircraft body portion 14, a pair of elongated attachment members 68 longitudinally extend transversely along top side portions of opposite end portions of the central beam section 36 and are suitably anchored, as at 70, at their opposite ends to the side edge struts 46 of the central section 36. Each of the attachment members 68 has a spaced pair of top side projections 72 disposed thereon, each projection 72 being configured to be complementarily received in the interior of one of the mounting blocks 32,34 (see FIG. 3) secured to the bulkheads 26,28.

To operatively secure the object mounting system 10 to the underside of the aircraft 16, the central beam section 36 is disposed horizontally beneath the bottom aircraft body portion side 12 and the attachment member projections 72 are extended upwardly through small openings 74 in the floor 24 (see FIG. 2) into the interiors of the four interior mounting blocks 32,34 (see FIGS. 3 and 4) and anchored in place within the mounting blocks 32,34 with suitable fasteners such as bolts 76. With the upwardly and outwardly angled beam end sections 38,40 anchored in place on the ends of the central beam section 36, the weaponry 64,66 may be operatively secured to the bomb racks 56 as shown.

As can be seen, the structure for securing the object mounting system 10 on the underside of the aircraft 16 (namely the telescoped mounting blocks 34,34 and attachment member projections 72) do not materially intrude into the interior of the cabin area 22 of the aircraft 16, and the central beam section 36 does not pass through the cabin area 22. The mounted weaponry 64,66 is desirably positioned laterally outwardly of the opposite sides 18,20 of the aircraft in an upwardly offset relationship with its underside, with the central beam section 36 appropriately extended through the skid structure or offset relative to the landing gear structure (neither of which is shown) of the helicopter or fixed wing aircraft as the case may be. Compared to conventional tubular through-sidewall mounting of the weaponry, the illustrated object mounting system 10 provides a substantially greater degree of support rigidity (and thus increased firing accuracy) together with substantially reduced object mounting system weight.

The foregoing detailed description is to be clearly understood as being given by way of illustration and example only, the spirit and scope of the present invention being limited solely by the appended claims.

What is claimed is:

1. An object mounting system for an aircraft having an elongated body portion having a length, and a bottom exterior side underlying an interior area within the body portion, and opposite exterior sides extending upwardly from the bottom exterior side, said object mounting system comprising:

an elongated mounting structure having a horizontally positionable central longitudinal section with outer ends to which upturned opposite longitudinal end sections of said mounting structure are secured;

support structures, disposed on outer ends of said longitudinal end sections, for removably and supportingly securing objects on said longitudinal end sections; and attachment apparatus for horizontally and fixedly securing said mounting structure central longitudinal section to the bottom exterior side of the aircraft body portion in a manner such that said central longitudinal section is beneath the bottom exterior side of the aircraft body portion and longitudinally extends transversely to the length of the aircraft body portion, with said support structures being horizontally spaced outwardly apart from the exterior sides of the aircraft body portion, said attachment apparatus including a first attachment structure securable within the interior area, and a second attachment structure secured to said central longitudinal section and being attachable to said first attachment structure, a portion of said second attachment structure being extendable through at least one opening in the bottom exterior side of the aircraft.

2. The object mounting system of claim 1 wherein:

said mounting structure has a non-tubular configuration.

3. The object mounting system of claim 1 wherein:

said mounting structure is of a honeycombed metal construction.

4. The object mounting system of claim 1 wherein:

said mounting structure has a generally plank-shaped configuration.

5. The object mounting system of claim 1 wherein:

said opposite longitudinal end sections are removably secured to said opposite ends of said central longitudinal section.

6. The object mounting system of claim 1 wherein:

each of said upturned opposite longitudinal end sections is upturned at an angle of between about thirty degrees and about forty five degrees relative to said central longitudinal section.

7. The object mounting system of claim 1 wherein:

said support structures are weaponry support structures.

8. The object mounting system of claim 7 wherein:

said weaponry support structures are bomb racks.

9. The object mounting system of claim 1 wherein:

said first and second attachment structures are releasably telescopeable with one another.

10. The object mounting system of claim 9 wherein:

said first attachment structure is a hollow block member securable within the interior area, and said second attachment structure is a lug member telescopingly and releasably receivable in said hollow block member.

11. The object mounting system of claim 1 in combination with an object mounted on one of said support structures.

12. The combination of claim 11 wherein:

said object is a weapon.

13. The combination of claim 12 wherein:

said weapon is a weapon selected from the group consisting of machine guns, rocket launchers and missiles.

14. Aircraft apparatus comprising:

an aircraft having an elongated body portion with a bottom exterior side underlying an interior area within said body portion, and opposite exterior sides extending upwardly from said bottom exterior; and a weaponry mounting system including:

an elongated mounting structure having a horizontally positioned central section disposed transversely beneath said bottom exterior side of said aircraft, said central section having opposite ends to which upturned opposite longitudinal end sections of said mounting structure are secured, said longitudinal end sections having outer ends and being horizontally spaced outwardly apart from said opposite exterior sides of said body portion, weaponry support structures, disposed on said outer ends of said longitudinal end sections, for removably and supportingly securing weaponry on said longitudinal end sections, and attachment apparatus fixedly securing said central section to said bottom exterior side of said aircraft, said attachment apparatus including a first attachment structure secured within the interior area, and a second attachment structure extending through said bottom exterior side of said aircraft and intersecuring said central longitudinal section and said first attachment structure.

15. The aircraft apparatus of claim 14 wherein:

said aircraft apparatus is a helicopter.

16. The aircraft apparatus of claim 15 wherein:

said interior area is a cabin area of said helicopter.

17. The aircraft apparatus of claim 14 wherein:

said mounting structure has a non-tubular configuration.

18. The aircraft apparatus of claim 14 wherein:

said mounting structure is of a honeycombed metal construction.

19. The aircraft apparatus of claim 14 wherein:

said mounting structure has a generally plank-shaped configuration.

20. The aircraft apparatus of claim 14 wherein:

said upturned opposite longitudinal end sections are removably secured to said opposite ends of said central longitudinal section.

21. The aircraft apparatus of claim 14 wherein:

each of said upturned opposite longitudinal end sections is upturned at an angle of between about thirty degrees and about forty five degrees relative to said central longitudinal section.

22. The aircraft apparatus of claim 14 wherein:

said weaponry support structures are bomb racks.

23. The aircraft apparatus of claim 14 further comprising:

weapons mounted on said support structures.

24. The aircraft apparatus of claim 23 wherein:

said weapons are weapons selected from the group consisting of machine guns, rocket launchers and missiles.

25. The aircraft apparatus of claim 14 wherein:

said first and second attachment structures are releasably telescoped with one another.

26. The aircraft apparatus of claim 25 wherein:

said first attachment structure is a hollow block member secured within said interior area, and said second attachment structure is a lug member telescopingly and releasably received in said hollow block member.

* * * * *